US005771832A

United States Patent [19]

MacDiarmid et al.

[11] Patent Number: 5,771,832

[45] Date of Patent: Jun. 30, 1998

[54] CLEW BOARD WITH TRAVELLER FOR SELF TACKING HEAD SAILS

[75] Inventors: Ian Cameron MacDiarmid; Norman James Longworth, both of New South Wales, Australia

[73] Assignee: Ausman Engineering and Associates Pty. Ltd., New South Wales, Australia

[21] Appl. No.: 834,278

[22] Filed: Apr. 15, 1997

[30] Foreign Application Priority Data

Apr. 16, 1996 [AU] Australia ..... PN9316

[51] Int. Cl.[6] ..... B63H 9/04

[52] U.S. Cl. ..... 114/106; 114/115

[58] Field of Search ..... 114/102, 103, 114/104, 105, 106, 107, 108, 109, 111, 112, 113, 114, 115

[56] References Cited

U.S. PATENT DOCUMENTS 3,270,494 9/1966 Holmes ..... 114/108

3,851,609 12/1974 Stearn ..... 114/108

4,059,063 11/1977 Hood et al. ..... 114/102

5,167,198 12/1992 Bonnet ..... 114/111

*Primary Examiner*—Stephen Avila

*Attorney, Agent, or Firm*—Leydig, Voit & Mayer, Ltd.

[57] ABSTRACT

A sail fastening apparatus (18) for a yacht. The apparatus (18) comprises a first track (21) extending along a sail clew (12) in a direction generally normal to a preferred vertical sheeting angle of the sail, a first carriage (22) slidably mounted for movement along the first track (21), and a sheet (16) extending between the first carriage and a sheeting point (27) on the yacht aft of the clew. The first carriage tends automatically to adopt a stable equilibrium position on the track such that the preferred vertical sheeting angle (B) for the sail is maintained.

9 Claims, 4 Drawing Sheets

6
D
B
21
18
∠B−C
C
22
16
7
23
26
25
16
27
A

CLEW BOARD WITH TRAVELLER FOR SELF TACKING HEAD SAILS

The present invention relates to marine vessels and more particularly to a sail fastening system for yachts.

The invention has been developed primarily for use in connection with self-tacking headsails and will be described hereinafter with reference to this application. It will be appreciated, however, that the invention is not limited to this particular field of use.

Self-tacking headsails are well known and typically comprise a mechanism for attaching the clew or lower trailing corner of the headsail to the hull or deck of the yacht by a mounting arrangement which permits the attachment point to travel athwartships or transversely across the deck. This arrangement avoids the need to adjust or reposition the rope or sheet extending between the headsail clew and the deck, each time the vessel changes tack. A typical mounting arrangement comprises a track extending across the deck aft of the headsail to support a sliding carriage or traveller which carries the lower sheet pulley. Such arrangements are particularly popular for cruising yachts, which are normally manned by relatively small crews. A limitation inherent with this system, however, is that as the traveller slides across the track, the vertical sheeting angle changes whereas optimum performance of the sail relies upon the preferred sheeting angle being maintained.

Developments have also been made to mechanisms for furling or rolling headsails around the forestay. Such furling rollers facilitate stowage of the sail when not in use and also allow partial reefing to reduce the sail area when required under certain conditions, for example, in strong winds. With such arrangements, as the headsail is progressively reefed, the clew rolls up at right angles to the furler and hence to the luff or leading edge of the sail. However, because the locus of the clew during furling is inclined with respect to the optimum sheeting angle, partial furling also progressively changes the sheeting angle.

In both situations described above the leech or trailing edge of the headsail will go slack whilst the foot or lower edge becomes overly tight or vice versa. The consequence of this is that the angle of incidence to the wind of the upper part of the sail is altered from the optimum, thereby diminishing the efficiency of the sail as a whole.

In an attempt to address this problem, in the past a mechanism has been provided to permit adjustment of the position of the headsail sheet on the clew by means of a series of spaced apart eyelets formed in the clew. Thus, in any given situation the headsail sheet may be connected to the particular eyelet which most closely corresponds to the preferred vertical sheeting angle. However, this arrangement has several inherent limitations. Firstly, because the eyelets are spaced apart by discrete intervals, fine tuning of the sheeting angle at intermediate positions is not possible. Furthermore, in order to change the sheet from one eyelet to another, it must first be disconnected and then reconnected in the new position. This is a difficult and time-consuming operation at the best of times but particularly with a small crew. It is also extremely hazardous and potentially even fatal in high wind conditions, because of the possibility of the headsail breaking free and flapping unrestrained.

Another method of adjusting the sheeting angle is by moving the sail up or down the forestay. However, the sail must first be unfurled, which again is difficult and potentially hazardous, particularly in high wind conditions.

A more classical attempt at a solution is to move the sheet attachment point on the hull forwardly as the sail is reefed.

However, this too is time consuming and inconvenient, particularly with a small crew, and in the case of self-tacking headsails, such movement is not possible because the track is not able to be moved fore and aft on the deck.

It is an object of the present invention to overcome or substantially ameliorate at least some of these deficiencies of the prior art.

Accordingly, the invention as presently contemplated provides a sail fastening apparatus for a yacht, said apparatus comprising a first track extending along a sail clew in a direction generally normal to a preferred vertical sheeting angle of the sail, a first carriage slidably mounted for movement along the first track, and a sheet extending between the first carriage and a sheeting point on the yacht aft of the clew, whereby the first carriage tends automatically to adopt a stable equilibrium position on the track such that a preferred vertical sheeting angle for the sail is maintained.

The apparatus preferably forms part of a self-tacking headsail assembly further including a second track extending transversely across the deck of the yacht, and a second carriage slidably mounted on the second track for movement athwartships as the yacht changes tack. Preferably, the first carriage supports an upper pulley and the second carriage supports a lower pulley for the headsail sheet.

The headsail is preferably mounted on a self furling roller, such that the respective first and second track and carriage assemblies interact to maintain the preferred vertical sheeting angle as the sail is partially reefed onto the furling roller.

Each of the first and second carriages preferably comprises a recirculating ball (RCB) traveller to minimise friction.

A preferred embodiment of the invention will now be described, by way of example only, with reference to the accompanying drawings in which.

Figure 1:
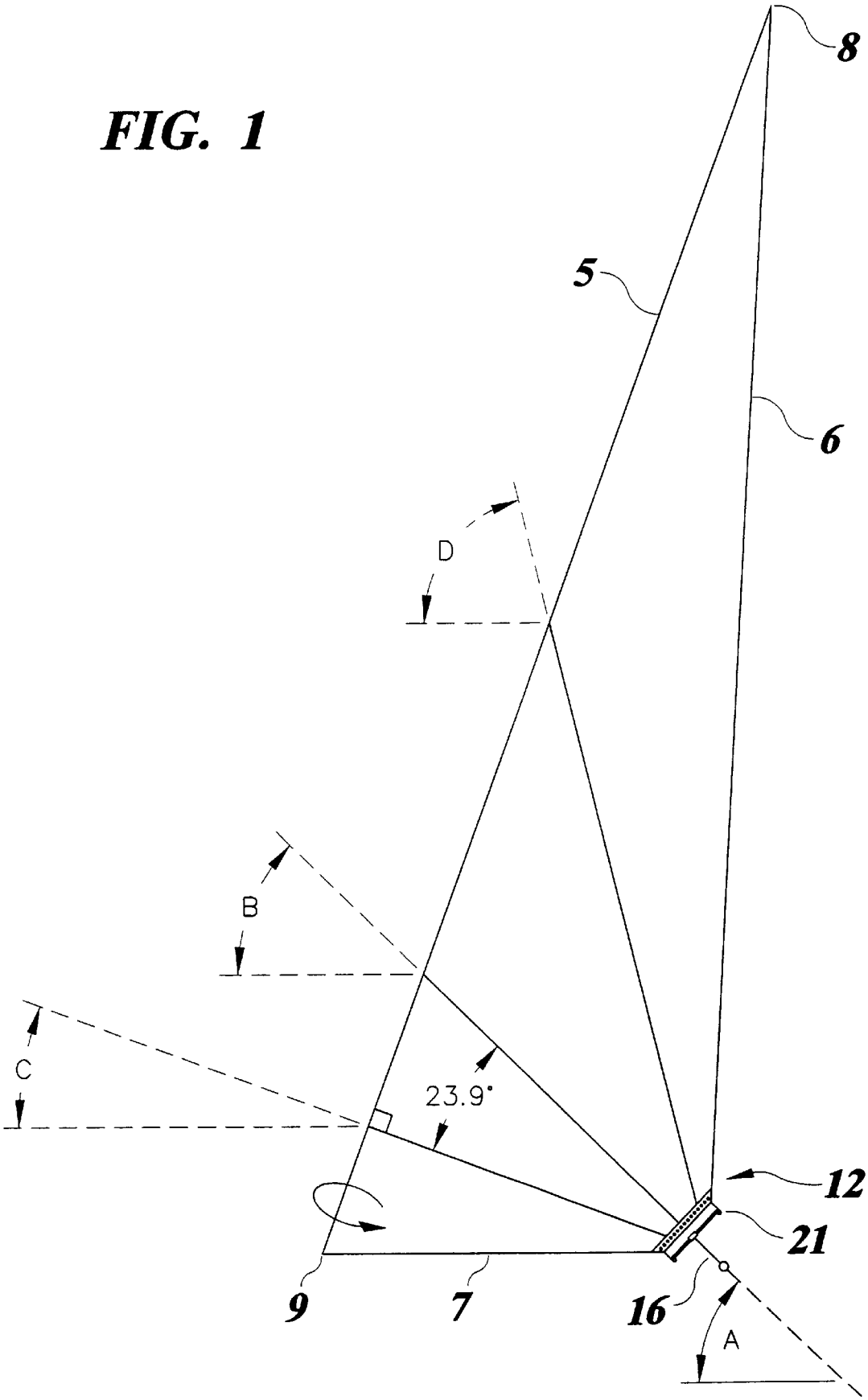
FIG 1 is a diagrammatic plan view of a headsail incorporating a clew fastening assembly according to the invention.
Figure 2:
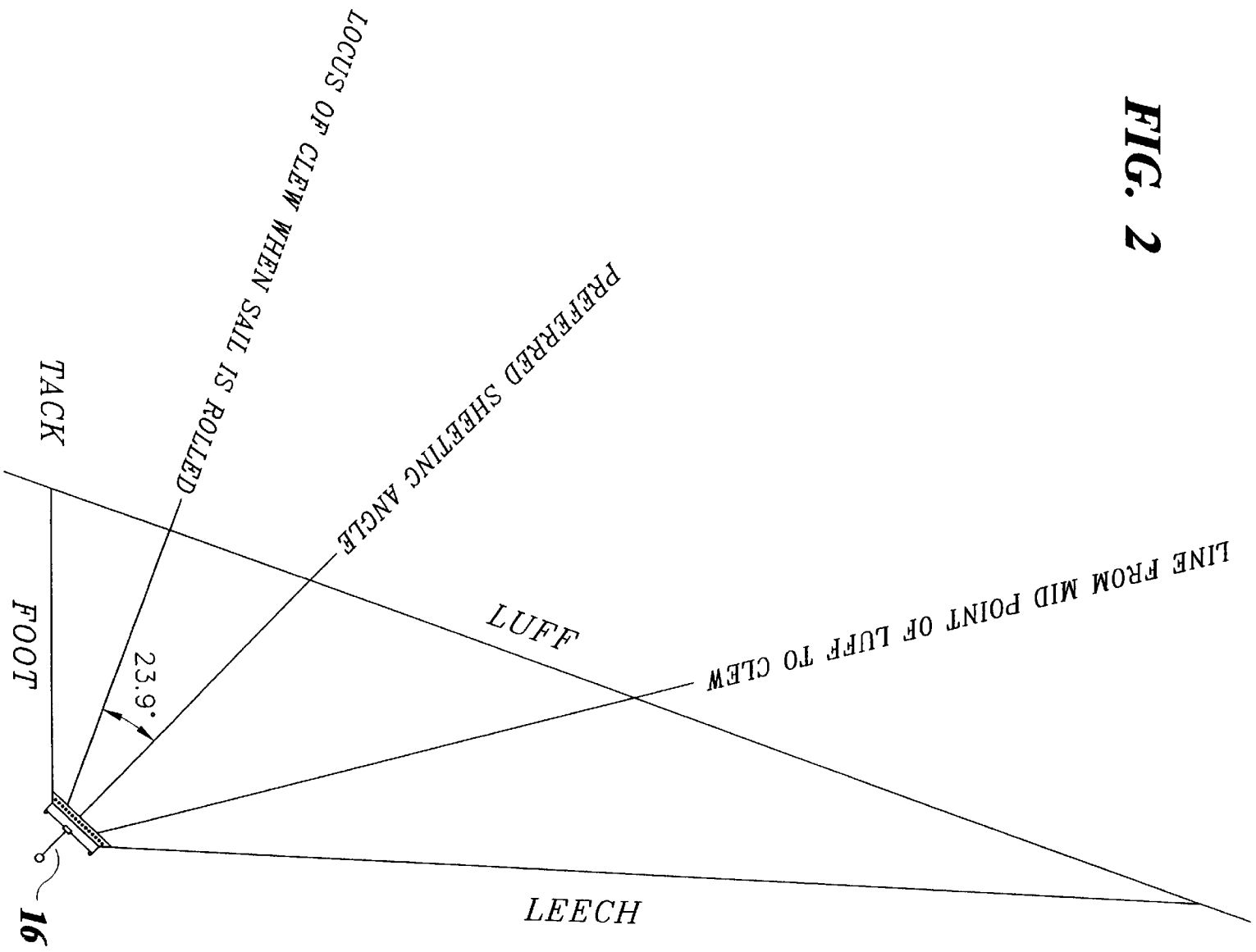
FIG. 2 shows the headsail of FIG. 1 partially reefed or furled.

Referring firstly to FIG. 1, by way of background information, a yacht sail is generally triangular in shape, defining a leading edge or luff 5, a trailing edge or leech 6 and a lower edge or foot 7. The head 8 of the sail is normally fastened toward the top of the mast (not shown) whilst the lower front corner or tack 9 is located anchored to the foredeck (see FIG. 4). In many vessels, the luff 5 of the headsail is connected to the forestay 10 by means of a furling roller 11. The lower trailing corner 12 of the sail is known as the clew, and typically incorporates an eyelet, or a series of eyelets, whereby the rearward portion of the sail is anchored to the hull or deck 15 by means of an adjustable rope and pulley arrangement known as the headsail sheet 16.

Referring again to FIG. 1, the vertical angle of inclination of the headsail sheet 16 defines the actual sheeting angle A, which is essentially the angle at which the clew is pulled toward the hull by the sheet. Any sail has an optimum or preferred sheeting angle B, which is related directly to the geometry of the sail as a whole, and which must be maintained in order for the sail to operate effectively and efficiently according to its design parameters. Other geometric variables in sail design include the perpendicular line from the luff to the clew as defined by angle C, which corresponds to the locus of the clew when furled around the forestay, and the line extending from the mid-point of the luff to the clew, inclined at angle D. Typically, the preferred sheeting angle B lies somewhere between these two lines, i.e. between angles C and D.

Figure 3:
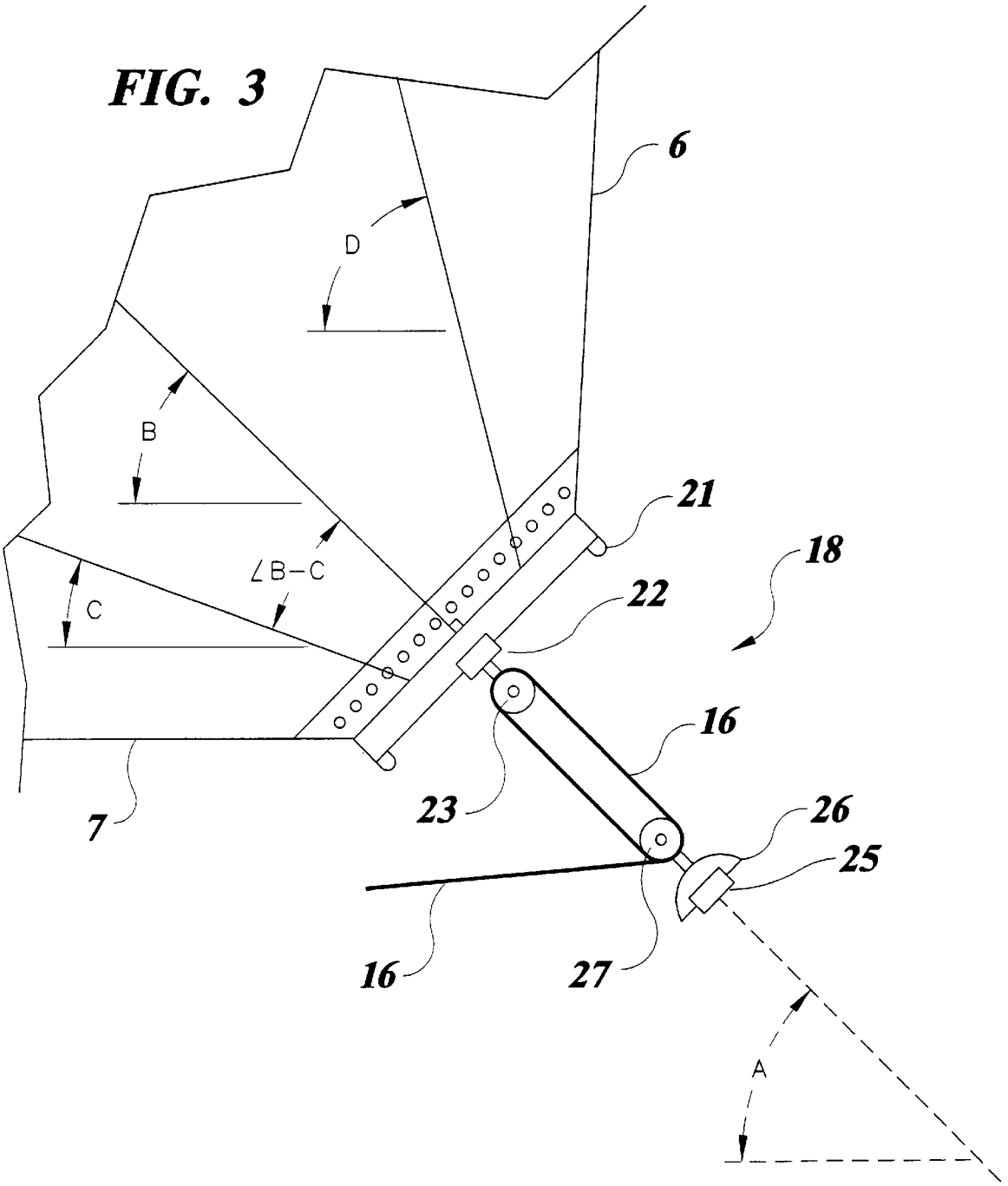
FIG. 3 is an enlarged view showing the clew fastening assembly of FIGS. 1 and 2 in more detail.

As best seen in FIG. 3, the present invention provides a sail fastening apparatus 18 comprising a first track 21 extending along the clew in a direction generally normal to the preferred vertical sheeting angle B of the sail. A first carriage in the form of a recirculating ball (RCB) traveller 22 is slidably mounted to first track. An upper headsail sheet pulley 23 is mounted to the traveller 22 and is thereby permitted freely to traverse the track 21.

Figure 4:
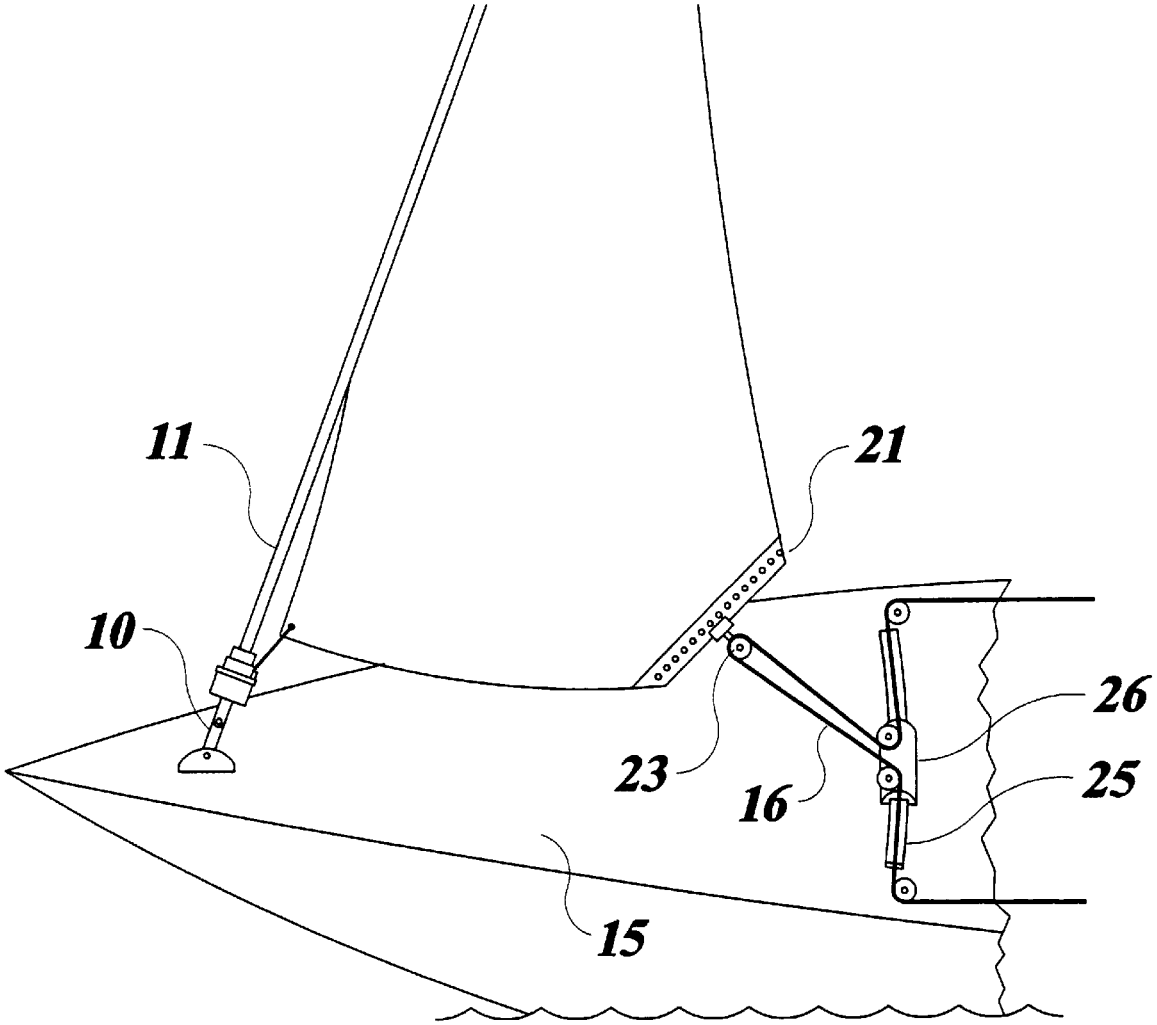
FIG. 4 is a diagrammatic perspective view showing the clew fastening assembly of FIGS. 1 to 3 as fitted to a self furling, self-tacking headsail on a cruising yacht.

The invention, in its preferred form, further provides a second track 25 extending athwartships across the deck, behind the headsail (see FIG. 4). A second traveller 26, also of the recirculating ball (RCB) type, is slidably mounted to the second track. The second traveller supports a lower headsail sheet pulley 27, so as to form part of a self-tacking headsail arrangement. The headsail sheet 16 extends between the upper and lower pulleys 23 and 27, and additional pulleys as may be required, to enable the tension in the headsail sheet to be varied to suit prevailing conditions.

It will be appreciated from the geometry that the clew traveller 22 will tend automatically to adopt a stable equilibrium position on the clew track 21 such that the actual sheeting angle A always coincides with the optimum or preferred sheeting angle B. For example, if the headsail is partially reefed onto the furler 11 to reduce sail area, the clew traveller 22 would rise upwardly along the clew track to maintain the preferred sheeting angle, and vice versa if the sail is unfurled. This occurs because the clew track is generally normal to the preferred sheeting angle B and so the position of minimum potential energy for the traveller occurs when the actual sheeting angle coincides with the preferred sheeting angle. Similar adjustments occur automatically as the second traveller, supporting the lower sheet pulley 27, traverses the second track 25, when the vessel changes tack. Thus, the headsail is maintained in a condition of optimum trim throughout changing conditions, without the need manually to disconnect and reposition the sheet on the clew, thereby obviating the time, effort and dangers previously associated with this process. Thus, the invention represents a significant improvement over the prior art.

Although the invention has been described with reference to a specific example, it will be appreciated by those skilled in the art that the invention may be embodied in many other forms. For example, the clew track need not necessarily be straight, but could be curved. Also, the orientation of the track on the clew could be adjustable to facilitate minor trim changes in situ. Also, travel limiters, either elastic or rigid, could be provided on the clew track to confine the range of motion, and to facilitate trimming. It will also be appreciated that the invention is not limited to use with self-furling or self-tacking headsails, but is applicable in virtually any sailing environment.

We claim:

1. A sail fastening apparatus for a yacht, said apparatus comprising a first track extending along a sail clew in a direction generally normal to a preferred vertical sheeting angle of the sail, a first carriage slidably mounted for movement along the first track, and a sheet extending between the first carriage and a sheeting point on the yacht aft of the clew, whereby the first carriage tends automatically to adopt a stable equilibrium position on the track such that the preferred vertical sheeting angle for the sail is maintained.

2. A sail fastening apparatus according to claim 1, wherein the sail is a headsail and the sheet is a headsail sheet.

3. A sail fastening apparatus according to claim 2, wherein the apparatus forms part of a self-tacking headsail assembly.

4. A sail fastening apparatus according to claim 3, further including a second track extending generally transversally across the deck of the yacht, and a second carriage slidably mounted on the second track for movement athwartships as the yacht changes tack.

5. A sail fastening apparatus according to claim 4, wherein the first carriage supports and upper pulley and the second carriage supports a lower pulley for the headsail sheet.

6. A sail fastening apparatus according to claim 5, wherein the headsail is mounted on a furling roller, such that the respective first and second track and carriage assemblies interact to maintain the preferred sheeting angle as the sail is progressively reefed onto the furling roller.

7. A sail fastening apparatus according to claim 1, wherein each carriage includes a re-circulating ball traveller adapted to minimise friction with respect to its track.

8. A sail fastening apparatus according to claim 4, wherein said second track is curved to minimise variations in the sheeting angle as the second traveller traverses the second track during changes in tack.

9. A sail fastening apparatus according to claim 1, further including selectively adjustable travel limiters associated with the clew track to confine the range of motion between predetermined limits and to facilitate trimming.

* * * * *

UNITED STATES PATENT AND TRADEMARK OFFICE

CERTIFICATE OF CORRECTION

PATENT NO. : 5,771,832
DATED : June 30, 1998
INVENTOR(S) : MacDiarmid et al

It is certified that error appears in the above-identified patent and that said Letters Patent is hereby corrected as shown below:

On the title page, item [56] Foreign Patent Documents insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | | | | | | | | | | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 7 | 7 | 7 | 8 | 0 | 9 | 4 | 01/1995 | AUSTRALIA | | | | |
| | | | | | | | | | | | | | | |

Signed and Sealed this

Ninth Day of February, 1999

*Attest:*

*Attesting Officer*

*Acting Commissioner of Patents and Trademarks*